US005547073A

United States Patent [19]

Smith

[11] Patent Number: 5,547,073

[45] Date of Patent: Aug. 20, 1996

[54] DISPLAY STAND ERECTABLE FROM SHIPPING CONTAINER

[75] Inventor: Michael J. Smith, Orangeburg, N.Y.

[73] Assignee: Arrow Art Finishers, Inc., Bronx, N.Y.

[21] Appl. No.: 350,402

[22] Filed: Dec. 5, 1994

[51] Int. Cl.[6] ..... B65D 5/52

[52] U.S. Cl. ..... 206/45.24; 206/736; 248/174

[58] Field of Search ..... 206/44 R, 44.11, 206/45.24, 45.25; 211/132; 248/174

[56] References Cited

U.S. PATENT DOCUMENTS

| | | | |
|---|---|---|---|
| 4,726,476 | 2/1988 | Smith | 206/44 R |
| 4,938,343 | 7/1990 | Willis | 211/132 |
| 4,991,804 | 2/1991 | Iannucci | 206/45.24 |
| 5,060,790 | 10/1991 | Kindelberger et al. | 206/45.11 |

FOREIGN PATENT DOCUMENTS

| | | | |
|---|---|---|---|
| 219176 | 4/1987 | European Pat. Off. | 206/45.24 |

*Primary Examiner*—David T. Fidei
*Attorney, Agent, or Firm*—Kirschstein, et al.

[57] ABSTRACT

A foldable display stand includes a generally box-shaped housing having an open end and a collapsible base for supporting the housing at an elevation above ground. The base includes a plurality of consecutive sections each having interconnected front, back and side walls displaceable relative to one another between their erected positions in which the respective section has a tubular shape, and their collapsed positions in which the walls lie flat against each other. These sections are connected to one another for movement between their unfolded positions in which they form continuations of one another, and their folded positions in which they are situated adjacent one another. One of such sections is mounted on the housing at its open end for pivoting between one position in which all of the sections are situated outside the housing, and another position in which all of the sections are located within the housing.

6 Claims, 2 Drawing Sheets

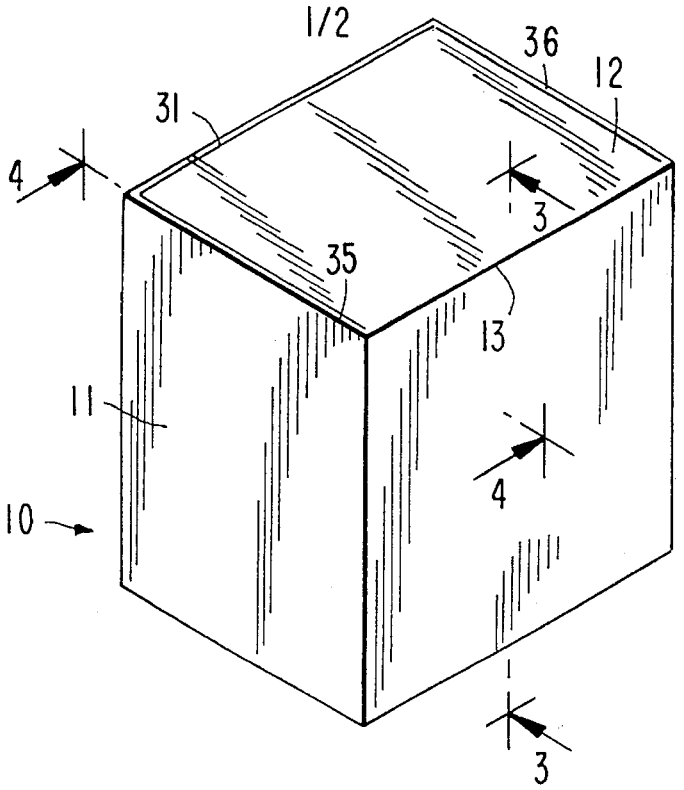
FIG.1
FIG.3
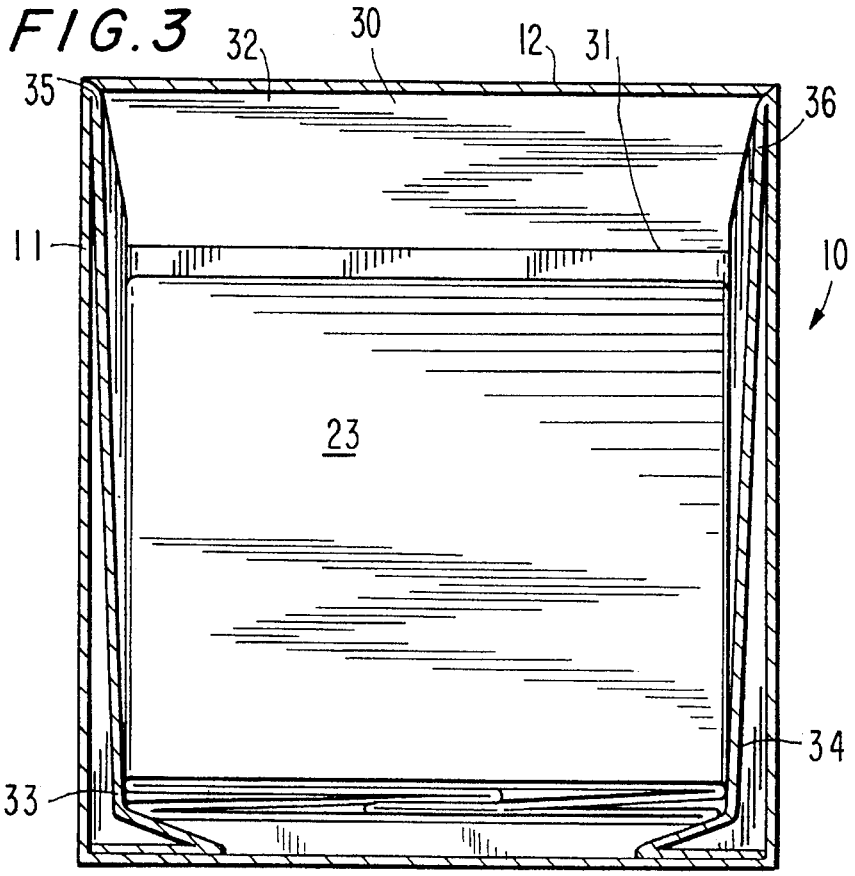

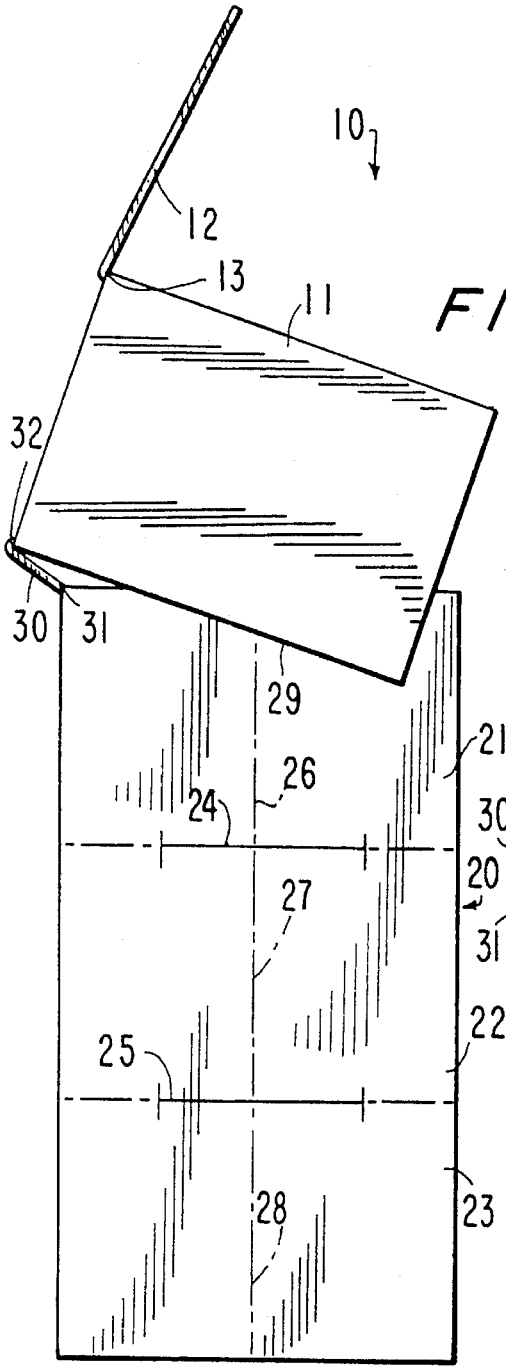
FIG. 2
FIG. 4
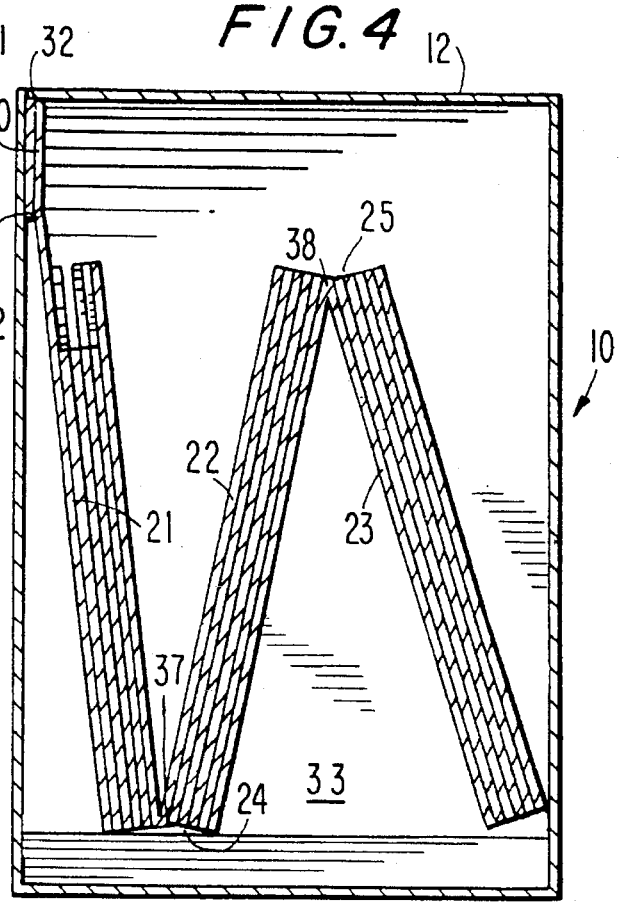

DISPLAY STAND ERECTABLE FROM SHIPPING CONTAINER

BACKGROUND OF THE INVENTION

1. Field of the Invention

The present invention relates to display arrangements in general, and more particularly to a display stand having a collapsible and/or foldable base.

2. Description of the Related Art

There are already known various constructions of collapsible display stands, among them such in which a collapsible and foldable base is hingedly connected to a display housing or receptacle for the goods to be put on display. Examples of such arrangements may be found in the French Patent No. 84 04211 and U.S. Pat. Nos. 4,726,476 and 4,813,536 where the collapsible base wraps around the exterior of the box-shaped housing when in its collapsed and folded storage and transportation state.

Such arrangements have several disadvantages. For example, in some cases, additional means besides the lid must probably be provided for holding the collapsed and folded base and/or the lid in position. Whether such holding means includes adhesive tape, staples, binding straps or other such known packaging fasteners, unsightly marks that detract from the appearance and aesthetic appeal of the display stand are almost invariably left behind after such fastening means is removed.

Also, in other cases, the known arrangements have to be shipped to a packing or retail site in a separate shipping container. The container must be separately discarded, thereby contributing to waste and unnecessary expense. Moreover, since the base of the stand is at least partially exposed to environmental influences while in storage and/or in transit, the likelihood that it will be soiled or even damaged before it reaches its final destination is substantial. Last but not least, some of the previously proposed display stands require extensive and complex manipulation and hence a high degree of skill for their erection. Since this level of skill is not always available at the point of use of the stand, this constitutes an additional source of possible damage to the stand.

SUMMARY OF THE INVENTION

Objects of the Invention

Accordingly, it is a general object of the present invention to avoid the disadvantages of the prior art.

More particularly, it is an object of the present invention to provide a foldable display stand which does not possess the drawbacks of the known arrangements of this type.

Still another object of the present invention is to devise a display stand of the type here under consideration in which the base is protected from damage during transportation, storage, and stand erection alike.

An additional object of the present invention is to devise the above display stand so that a separate shipping container is not needed.

It is yet another object of the present invention to design the above display stand in such a manner as to occupy a relatively small amount of space when collapsed, be easily convertible into its erected state, and extend to a considerable height from the ground when erected.

A concomitant object of the present invention is so to construct the display stand of the above type as to be relatively simple in construction, inexpensive to manufacture, easy to use, and yet reliable in operation.

Features of the Invention

In keeping with the above objects and others which will become apparent hereafter, one feature of the present invention resides in a foldable display stand that includes a generally box-shaped housing having an open end, and a collapsible base for supporting the housing at an elevation above ground. The base includes a plurality of consecutive sections each having interconnected front, back and side walls displaceable relative to one another between their erected positions in which the affected section has a tubular shape, and their collapsed positions in which the walls of that section lie flat against each other.

According to the invention, there are further provided means for connecting the sections to one another for movement between their unfolded positions in which they form continuations of one another, and their folded positions in which they are situated adjacent one another, and means for mounting one of the sections on the housing at the open end thereof for pivoting between one position in which all of the sections are situated outside the housing, and another position in which all of the sections are located within the housing.

A particular advantage of the arrangement according to the present invention as described so far is that the folded base is fully accommodated within the box-shaped housing when not being used. This makes the housing virtually indistinguishable from conventional shipping boxes not only as to its appearance but also, and even more importantly, as far as its handling is concerned. Moreover, the base, owing to its accommodation in the housing when not in use, is sheltered by the latter from damage that could occur to it if it were exposed to external influences. A separate shipping container is no longer necessary. The box-shaped housing itself serves as the shipping container.

It is particularly advantageous when, in accordance with the present invention, the mounting means includes a strip-shaped mounting member that is hingedly connected to the one section by a first hinge zone, and to the housing at the open end thereof by a second hinge zone substantially parallel to the one hinge zone. This construction of the mounting means renders it possible to easily manipulate the folded and/or collapsed base while introducing the same into or withdrawing it from the housing and assures that the base sections are properly positioned in the housing.

According to another facet of the invention, there is further provided constraining means within the housing for engaging the sections of the base in the second position thereof to maintain the same in place with predetermined forces. Such constraining means inhibits, if not prevents, movements of the base sections both transversely, i.e. parallel to the planes along which such sections extend, and front-to-back, that is generally normal to such planes in an accordion-like fashion, thus further reducing the danger of damaging the base sections.

Advantageously, the aforementioned one section includes at least one recess for receiving a portion of the housing in a slanted position in the erected condition. There is advantageously further provided a panel that is hingedly connected to the housing at the open end thereof and is displaceable between a position in which it extends across the open end, and another position in which it extends upwardly from the housing in the erected condition. This panel advantageously carries informational matter at least on a major surface thereof that faces passersby. This informational matter is descriptive of goods or objects packed into the housing when the housing is in the slanted position in the erected condition.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a perspective view of a foldable display stand embodying the present invention in its storage and transportation condition;

FIG. 2 is a side elevational view of the foldable display stand of FIG. 1 taken generally in the directions of arrows 4—4 thereof, but with the stand in its display condition;

FIG. 3 is a transverse sectional view taken on lines 3—3 of FIG. 1; and FIG. 4 is a cross-sectional view taken on lines 4—4 of FIG. 1.

DETAILED DESCRIPTION OF THE PREFERRED EMBODIMENT

Referring now to the drawing in detail, and first to FIG. 1 thereof, it may be seen that the reference numeral 10 has been used therein to identify a foldable display stand of the present invention in its entirety. The stand 10 includes, among others, a generally box-shaped housing 11 having an open end facing upwardly in FIG. 1, and a front panel 12 hingedly connected to a sidewall of the housing 11 at the open end by a unitary hinging portion 13. At this juncture, it is to be stated that all directions mentioned herein refer to the orientation when the stand 10 is ready for use or actually used for displaying selected goods and are being employed for identification purposes only, having no other significance.

As a comparison of FIGS. 1 and 2 will reveal, the front panel 12 is pivotable relative to the housing 11 about the hinging portion 13 between the position shown in FIG. 1 in which it closes the open end of the housing 11, and that depicted in FIG. 2 in which it extends upwardly from the housing 11. As a matter of fact, it may well be that the front panel could be moved into any intermediate position, or even beyond the upright position assumed in FIG. 2, possibly until it would be situated adjacent the top wall of the housing 11. However, it has been found to be advantageous to keep the front panel 12 more or less in the illustrated upright position of FIG. 2 when the stand 10 is in use, and to provide it at least on its surface that faces the passerby with advertisements or other informational matter relating to the goods on display and thus attracting attention to them. To this end, the front wall 12, also known as a header, and the top wall of the housing 11 may have, in a well-known and hence not illustrated manner, at least one plastically deformable but then shape-retaining wire or similar element embedded therein, this element extending continuously through the hinge portion 13. This element serves as a sort of "memory"—it "remembers" the position relative to the housing 11 into which the front panel 12 has been put, usually by purposeful human activity, and prevents the front panel 12 from moving out of this position to any significant extent.

FIG. 2 of the drawing also shows that the stand 10 further includes a base 20 as another of its important components. The base 20 is shown to consist of three sections 21, 22 and 23 that adjoin each other at respective parting zones indicated by reference numerals 24 and 25. The construction and significance of the parting zones 24 and 25 will become clearer as the present description proceeds. For the time being, it is sufficient to mention that the sections 21, 22 and 23 are joined to one another, albeit usually less than completely, at the parting zones 24 and 25, respectively, and they can be folded about them in an accordion-like fashion when in their collapsed conditions. To enable the sections 21, 22 and 23 to assume not only their erected conditions in which they are generally tubular or box-shaped and complement each other into the stand 20 as shown in FIG. 2, but also their collapsed conditions that are indicated in FIG. 3 and 4, their side walls that face the observer in FIG. 2 but correspondingly also those which face in the opposite direction are provided with crease lines 26, 27 and 28 about which the side walls can be bent inwardly so that they are eventually confined, in their folded-over positions, between the front and back walls of the sections 21, 22 and 23 that have thus moved as close to one anther as possible under the circumstances. This is what is referred to herein as the collapsed condition of the sections 21, 22 and 23.

FIG. 2 also indicates that the uppermost base section 21 is provided, in its side walls, with respective triangular recesses 29 (only one being visible in the drawing) in which the housing 11 is supported in a backwardly inclined position when the stand 10 is in its fully erected or operational condition of FIG. 2. It is also shown there that the housing 11 is connected to the base 20 by a generally strip-shaped mounting portion 30 that is pivotally connected to the base 20 by a unitary or integral hinge zone 31 and to the housing 11 by a similar or identical hinge zone 32. However, the connecting portion 30 does more than just connect the housing 11 to the base 20. More particularly, it guides the housing 11 towards its proper position relative to the base section 21 and its recesses 29 as the stand 10 is being erected, and actually helps in retaining the housing 11 in the recesses 29 against accidental and/or inadvertent removal therefrom.

Turning now to FIG. 3 of the drawing, it may be seen therein that the transverse dimension of the section 23 (as well as those of the sections 21 and 22) when collapsed is smaller than the corresponding dimension of the interior of the housing 11. This means not only that the sections 21 to 23 can be rather easily introduced into the interior of the housing 11 though its open end after they have been folded along the parting lines 24 and 25 by pivoting about the hinging zones 31 and 32, but also that, once accommodated in the housing 11, they would be free to conduct unrestricted translational or accordion-like movement therein, were it not for special measures taken in accordance with the present invention to avoid the noise and possible damage attending such unrestricted movement during transportation or the like. These measures include the provision of side constraints 33 and 34 that flank the collapsed sections 21 to 23. These constraints 33 and 34 are typically integrally connected to the housing 11 at its open end for pivoting relative to the housing 11 about respective hinge portions 35 and 36, and advantageously have the generally J-shaped or L-shaped configurations as shown or similar thereto. This means that the clearance into which the sections 21 to 23 are introduced narrows with increasing degree of penetration of the sections 21 to 23 into the interior of the housing 11, until the sections 21 to 23 and/or the constraints 33 and 34 have to yield to some extent. Of course, this means that the sections 21 to 23 are no longer free to conduct the aforementioned unrestrained movements.

FIG. 4 of the drawing show that the respective front or back walls of the sections 21 and 22, on the one hand, and of the sections 22 and 23, on the other hand, of the base 20 are actually separated from one another at the parting lines 24 and 25, being connected to one another at the opposite walls, though, by respective hinging regions 37 and 38, respectively. Experience has shown that this kind of connection, albeit incomplete, is ordinarily sufficient to ensure that the sections 21 to 23 properly sit on top of one another without giving way, and it greatly facilitates the folding of the sections 21 to 23 by significantly reducing the number of layers that have to be folded. At this juncture, it is to be mentioned that, while the side walls of the sections 21 to 23 have been omitted from FIG. 3 for the sake of simplicity, they may also be provided with corresponding strategically located folding-facilitating cuts at the parting lines 24 and 25. The front panel 12 has also been omitted from both FIGS. 3 and 4 to avoid unduly encumbering the same.

Thus, in accordance with this invention, the same box-shaped housing 11 in which the goods or merchandise are packed for display, also serves as its own shipping container since the base is accommodated entirely within the housing 11 during transport.

It will be understood that each of the elements described above, or two or more together, may also find a useful application in other types of constructions differing from the type described above.

While the present invention has been described and illustrated herein as embodied in a specific construction of a foldable display stand, it is not limited to the details of this particular construction, since various modifications and structural changes may be made without departing from the spirit of the present invention. So, for instance, some or all of the walls of the housing 11 may be doubled to reinforce the same. Also, each of the constraints 33 and 34, for example, may be constituted by separate panels. Also, it may be sufficient to use only one of the constraints 33 or 34 to keep the sections 21 to 23 in place, in which case the other constraint such as 35 or 34 may either be omitted or used to close the open end of the housing 11 in addition to and over the front panel 12.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

What is claimed is:

1. A foldable display stand, comprising:

a) a generally box-shaped housing having an open end;

b) a collapsible base for supporting the housing at an elevation above ground, said base including a plurality of consecutive sections each having interconnected front, back and side walls displaceable relative to one another between their erected positions in which the respective section has a tubular shape, and their collapsed positions in which the walls of each section lie flat against each other;

c) means for connecting the sections to one another for movement between their unfolded positions in which they form continuations of one another, and their folded positions in which they are situated adjacent one another; and d) means for mounting one of the sections on the housing at the open end thereof for pivoting between one position in which all of the sections are situated outside the housing, and another position in which all of the sections are fully accommodated and located entirely within the housing.

2. The display stand as defined in claim 1, wherein the mounting means includes a strip-shaped mounting member that is hingedly connected to the one section by a first hinge zone, and to the housing at the open end thereof by a second hinge zone substantially parallel to the one hinge zone.

3. The display stand as defined in claim 1, and further comprising constraining means within the housing for engaging the sections of the base in the second position thereof to maintain the same in place with predetermined forces.

4. The display stand as defined in claim 1, wherein the one section includes at least one recess for receiving a portion of the housing in a slanted position in the erected condition.

5. The display stand as defined in claim 1, and further comprising a panel hingedly connected to the housing at the open end thereof and displaceable between a position in which it extends across the open end to form a shipping container, and another position in which it extends upwardly from the housing in the erected condition.

6. The display stand as defined in claim 5, wherein said panel carries informational matter at least on a major surface thereof that faces passersby.

* * * * *